US012326077B2

(12) United States Patent
Schultz et al.

(10) Patent No.: US 12,326,077 B2
(45) Date of Patent: Jun. 10, 2025

(54) WELL COMPLETION SYSTEMS AND METHODS

(71) Applicant: THRU TUBING SOLUTIONS, INC., Newcastle, OK (US)

(72) Inventors: Roger L. Schultz, Ninnekah, OK (US); Andrew M. Ferguson, Moore, OK (US); Gary P. Funkhouser, Moore, OK (US); Justin Allison, Owasso, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/350,864

(22) Filed: Jul. 12, 2023

(65) Prior Publication Data

US 2025/0020049 A1 Jan. 16, 2025

(51) Int. Cl.

| | |
|---|---|
| ***E21B 33/13*** | (2006.01) |
| ***E21B 33/12*** | (2006.01) |
| ***E21B 43/114*** | (2006.01) |
| ***E21B 43/26*** | (2006.01) |
| *E21B 31/00* | (2006.01) |

(52) U.S. Cl.

CPC ..... *E21B 43/261* (2013.01); *E21B 33/12* (2013.01); *E21B 33/13* (2013.01); *E21B 43/114* (2013.01); *E21B 31/005* (2013.01)

(58) Field of Classification Search

CPC ..... E21B 43/261; E21B 43/114; E21B 33/12; E21B 33/13; E21B 31/005

See application file for complete search history.

(56) References Cited

U.S. PATENT DOCUMENTS

| | | | | |
|---|---|---|---|---|
| 10,233,719 | B2 * | 3/2019 | Schultz | E21B 33/13 |
| 11,566,498 | B2 | 1/2023 | Ferguson et al. | |
| 2006/0196667 | A1 * | 9/2006 | Alba | E21B 43/14 166/308.1 |
| 2006/0201675 | A1 * | 9/2006 | Ferguson | E21B 34/10 166/298 |
| 2008/0047707 | A1 * | 2/2008 | Boney | E21B 43/114 166/270 |
| 2015/0144342 | A1 * | 5/2015 | Schultz | E21B 21/103 166/298 |
| 2016/0340994 | A1 * | 11/2016 | Ferguson | E21B 23/14 |
| 2017/0335651 | A1 * | 11/2017 | Watson | E21B 27/02 |
| 2021/0017839 | A1 * | 1/2021 | Ferguson | E21B 43/119 |

* cited by examiner

*Primary Examiner* — Taras P Bemko

(74) *Attorney, Agent, or Firm* — Smith IP Services, P.C.

(57) ABSTRACT

A bottom hole assembly can include an abrasive perforator with at least one nozzle configured to direct an abrasive jet outward from the abrasive perforator, and a plug dispenser tool configured to discharge at least one plug via a plug discharge port into an annulus surrounding the plug dispenser tool. A method of completing a well can include deploying a bottom hole assembly into a wellbore, perforating at least one zone with an abrasive perforator of the bottom hole assembly, and then discharging at least one plug from a plug discharge port of a plug dispenser tool of the bottom hole assembly. The discharging step can include the plug displacing from an internal flow passage of the bottom hole assembly to an annulus formed between the bottom hole assembly and the wellbore.

23 Claims, 9 Drawing Sheets

WELL COMPLETION SYSTEMS AND METHODS

BACKGROUND

This disclosure relates generally to equipment utilized and operations performed in conjunction with a subterranean well and, in examples described below, more particularly provides well completion systems and methods.

Well completions typically provide for production of fluids from a well after it has been drilled. Frequently, it can be advantageous to stimulate a formation zone prior to production operations. Examples of stimulation operations include hydraulic fracturing, acidizing and other operations designed to enhance production or injection.

It will, therefore, be readily appreciated that improvements are continually needed in the art of completing wells. The present disclosure provides such improvements, which may be used in a variety of different well configurations and operations.

DETAILED DESCRIPTION

Figure 1:
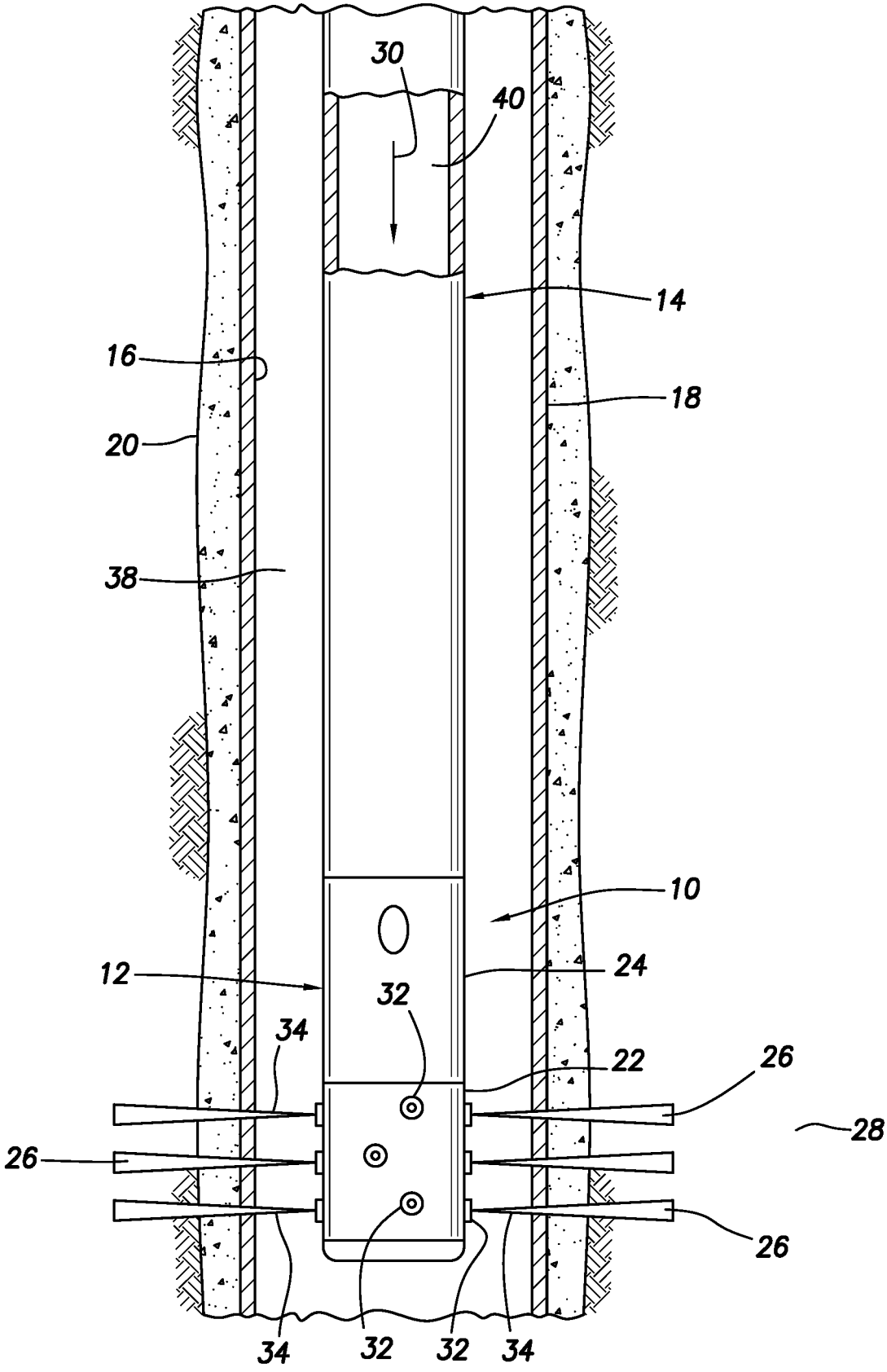
FIG. 1 is a representative partially cross-sectional view of an example of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, the system 10 includes a bottom hole assembly 12 connected at a distal end of a tubular string 14 deployed into a wellbore 16. The bottom hole assembly 12 is not necessarily deployed to a position in which it is at a bottom of the wellbore 16, but is instead "bottom hole" only in that it is configured to be connected at the distal end of the tubular string 14.

As depicted in FIG. 1, the wellbore 16 is generally vertical and is lined with casing 18 and cement 20. In other examples, the bottom hole assembly 12 may be deployed into inclined or generally horizontal sections of the wellbore 16. The wellbore 16 may be lined with materials other than casing, such as, liner, pipe, tubing, composite lining, formed in situ, or formed of any material.

In this example, the bottom hole assembly 12 provides for perforating and stimulating multiple zones of one or more subterranean formations in a single trip of the bottom hole assembly 12 into the wellbore 16. The tubular string 14 used to deploy and position the bottom hole assembly 12 in the wellbore may comprise jointed or continuous tubing or pipe.

The FIG. 1 bottom hole assembly 12 includes at least an abrasive perforator 22 and a plug dispenser tool 24. The abrasive perforator 22 is preferably connected downhole of the plug dispenser tool 24, but in some examples the abrasive perforator could be connected uphole of the plug dispenser tool.

As depicted in FIG. 1, the abrasive perforator 22 is appropriately positioned at a location where it is desired to form perforations 26 from the wellbore 16 into a zone 28. An abrasive slurry 30 is pumped from surface through an internal flow passage 40 of the tubular string 14. The abrasive slurry 30 exits nozzles 32 of the abrasive perforator 22, thereby forming abrasive jets 34.

The abrasive jets 34 cut through the casing 18 and cement 20, and into the zone 28, thereby forming the perforations 26. Fluid communication is now permitted between the wellbore 16 and the zone 28 via the perforations 26.

Figure 2:
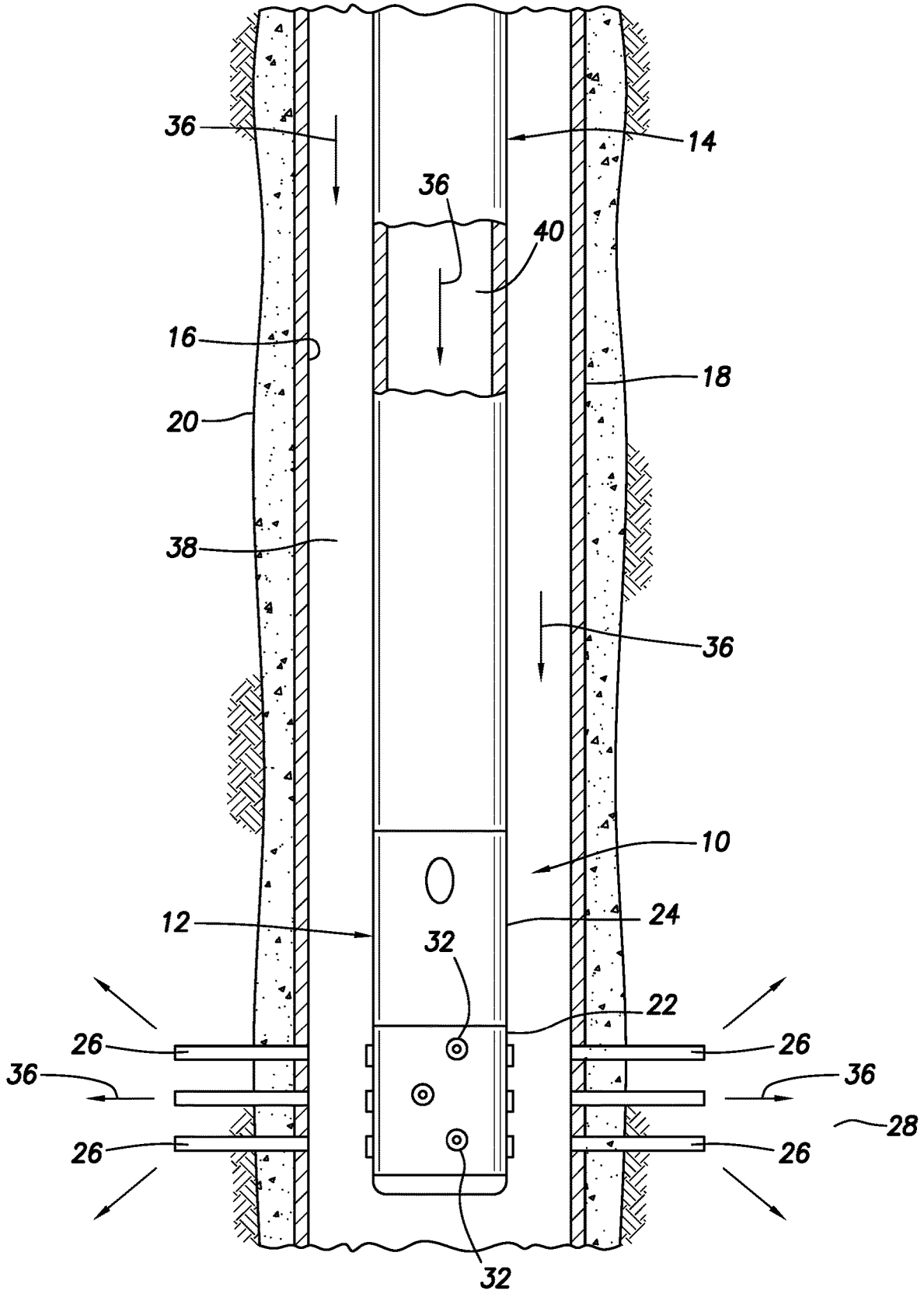
FIG. 2 is a representative partially cross-sectional view of the well system and method, in which a perforated zone is being stimulated.

Referring additionally now to FIG. 2, the system 10 and method are representatively illustrated after the perforations 26 have been formed. The zone 28 can now be stimulated by pumping a stimulation fluid 36 from the surface via an annulus 38 formed between the tubular string 14 and the wellbore 16.

The stimulation fluid 36 may comprise any fluid or combination of fluids used to enhance flow through the zone 28, such as, fracturing fluid with or without proppant, acid, conformance treatment, permeability modifier, etc. The purpose of the stimulation operation may be to enhance production of fluids from, or injection of fluids into, the zone 28.

The stimulation fluid 36 may be pumped only after pumping of the abrasive slurry 30 ceases, or in some examples there could be some overlap in the pumping of the stimulation fluid and the abrasive slurry. In some examples, the stimulation fluid 36 may be pumped through the internal flow passage 40 of the tubular string 14 (and out of the nozzles 32 of the abrasive perforator 22) instead of, or in addition to, pumping the stimulation fluid through the annulus 38.

The stimulation fluid 36 flows into the zone 28 via the perforations 26. In some examples, the zone 28 may fracture as a result of pumping the stimulation fluid 36 into the zone.

Figure 3:
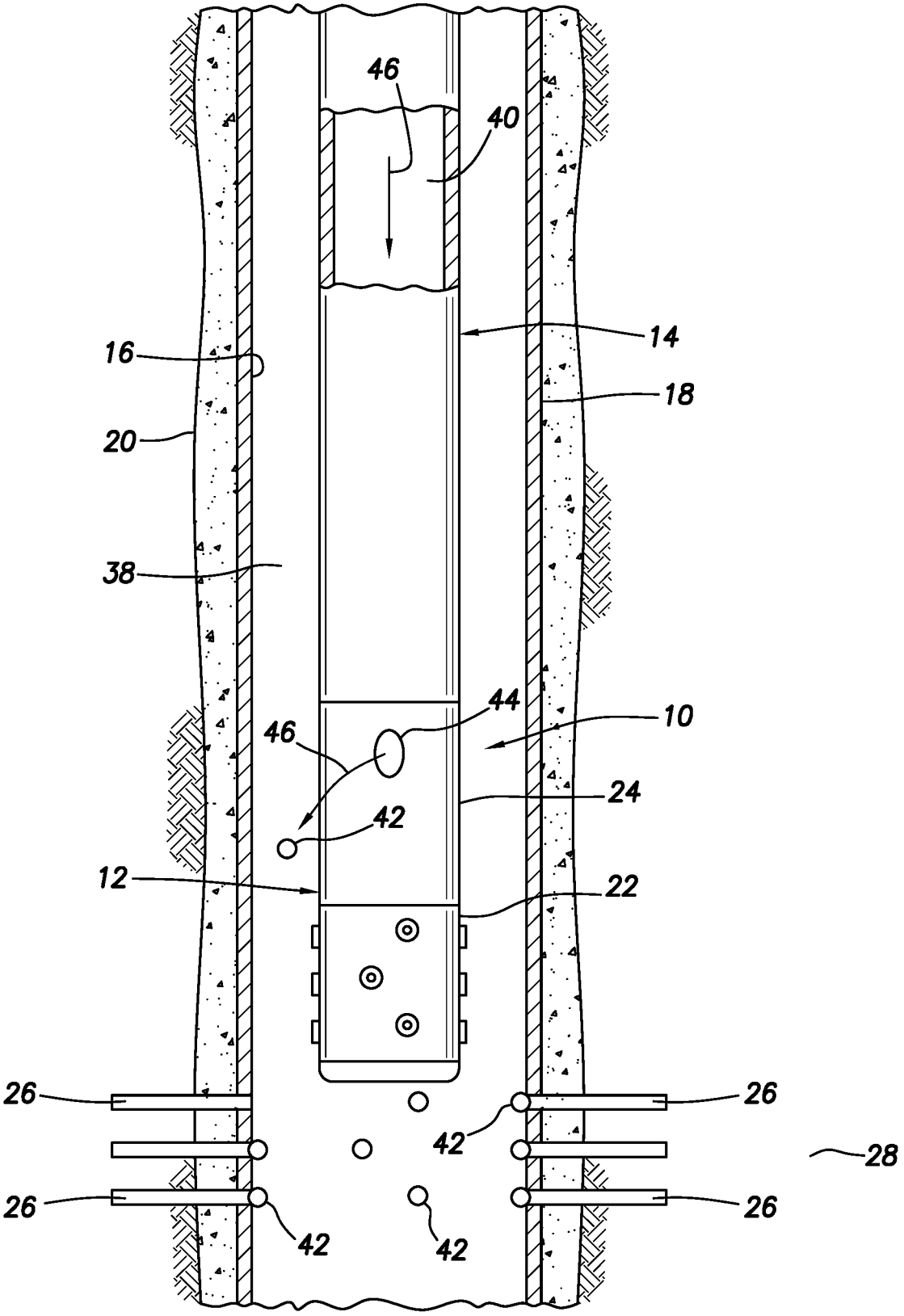
FIG. 3 is a representative partially cross-sectional view of the well system and method, in which the stimulated zone is being isolated.

Referring additionally now to FIG. 3, the system 10 and method are representatively illustrated after completion of the stimulation operation. The bottom hole assembly 12 has been displaced uphole to a position in which the abrasive perforator 22 is no longer opposite the perforations 26. At the perforations 26, the wellbore 16 is now unobstructed by the bottom hole assembly 12.

Plugs 42 can now be discharged from the plug dispenser tool 24 into the annulus 38. In this example, the plugs 42 are discharged from a plug discharge port 44 in a side of the plug dispenser tool 24. The plugs 42 engage the perforations 26 to thereby prevent fluid flow from the wellbore 16 to the zone 28 via the perforations.

The plugs 42 may be any suitable plugging devices configured to engage and block flow outward through the perforations 26. The plugs 42 are depicted in FIG. 3 as being generally round or spherical, similar to a conventional "frac ball" or "diverter ball." In other examples, other plug shapes (such as, cylindrical, conical, dart-shaped, etc.) may be used. Some examples of suitable plugs are described in U.S. Pat. No. 10,851,615, the entire disclosure of which is incorporated herein by this reference for all purposes.

As depicted in FIG. 3, the plugs 42 are displaced from the surface with fluid 46 through the internal flow passage 40 of the tubular string 14. The plugs 42 may be displaced individually through the tubular string 14, or multiple plugs may be displaced concurrently through the tubular string. The fluid 46 used to displace the plugs 42 may be the same as, or different from, the stimulation fluid 36.

Figure 4:
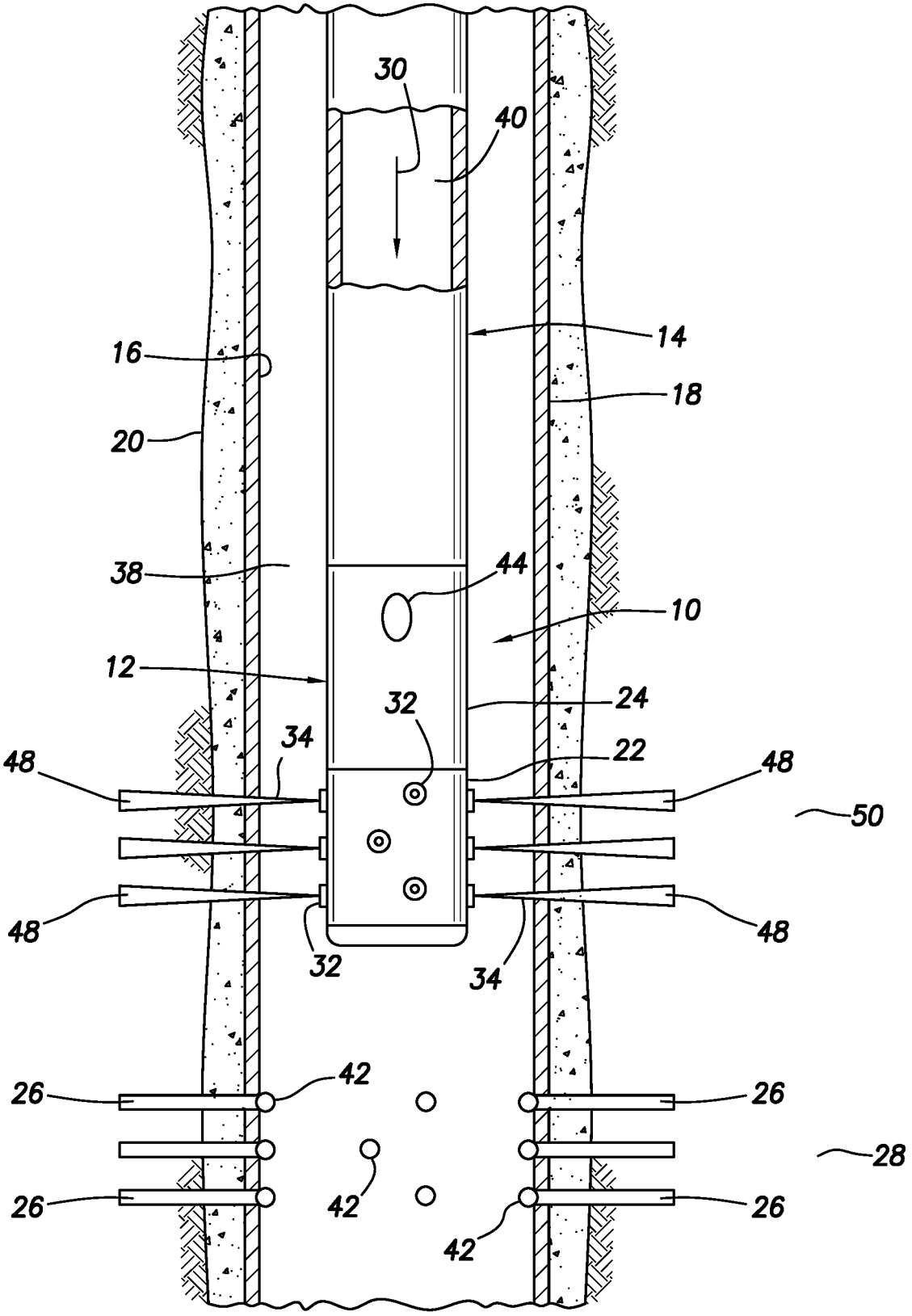
FIG. 4 is a representative partially cross-sectional view of the well system and method, in which another zone is being perforated.

Referring additionally now to FIG. 4, the system 10 and method are representatively illustrated after all of the perforations 26 have been plugged. Fluid flow from the wellbore 16 to the zone 28 via the perforations 26 is now fully blocked.

The bottom hole assembly 12 has been displaced uphole to a position in which it is desired to form additional perforations 48 into another zone 50. An abrasive slurry 30 is pumped from the surface through the internal flow passage 40, and exits as jets 34 from the nozzles 32 of the abrasive perforator 22.

The jets 34 cut the perforations 48 through the casing 18 and cement 20, and into the zone 50. Fluid communication is now permitted between the wellbore 16 and the zone 50 via the perforations 48.

Note that the steps described above for forming the perforations 48 into the zone 50 are the same as, or substantially similar to, the steps for forming the perforations 26 into the zone 28. In a similar manner, the zone 50 may be stimulated, possibly fractured, and then the perforations 48 plugged, as described above for the zone 28.

Thus, it will be appreciated that any number of zones can be perforated and stimulated using the bottom hole assembly 12 in a single trip into the wellbore 16. Each of the zones can be plugged (using the plugs 42 to block the perforations) after the zone is stimulated, in order to isolate the zone from stimulation treatments of other zones, except that the last perforated zone would not need to be plugged.

In some examples, multiple sets of perforations 26, 48 may be formed using the abrasive perforator 22. After stimulation via the multiple sets of perforations 26, 48, all or less than all of the sets of perforations may be plugged. Thus, it is not necessary for all of the open perforations 26, 48 to be plugged after stimulation.

Figure 5:
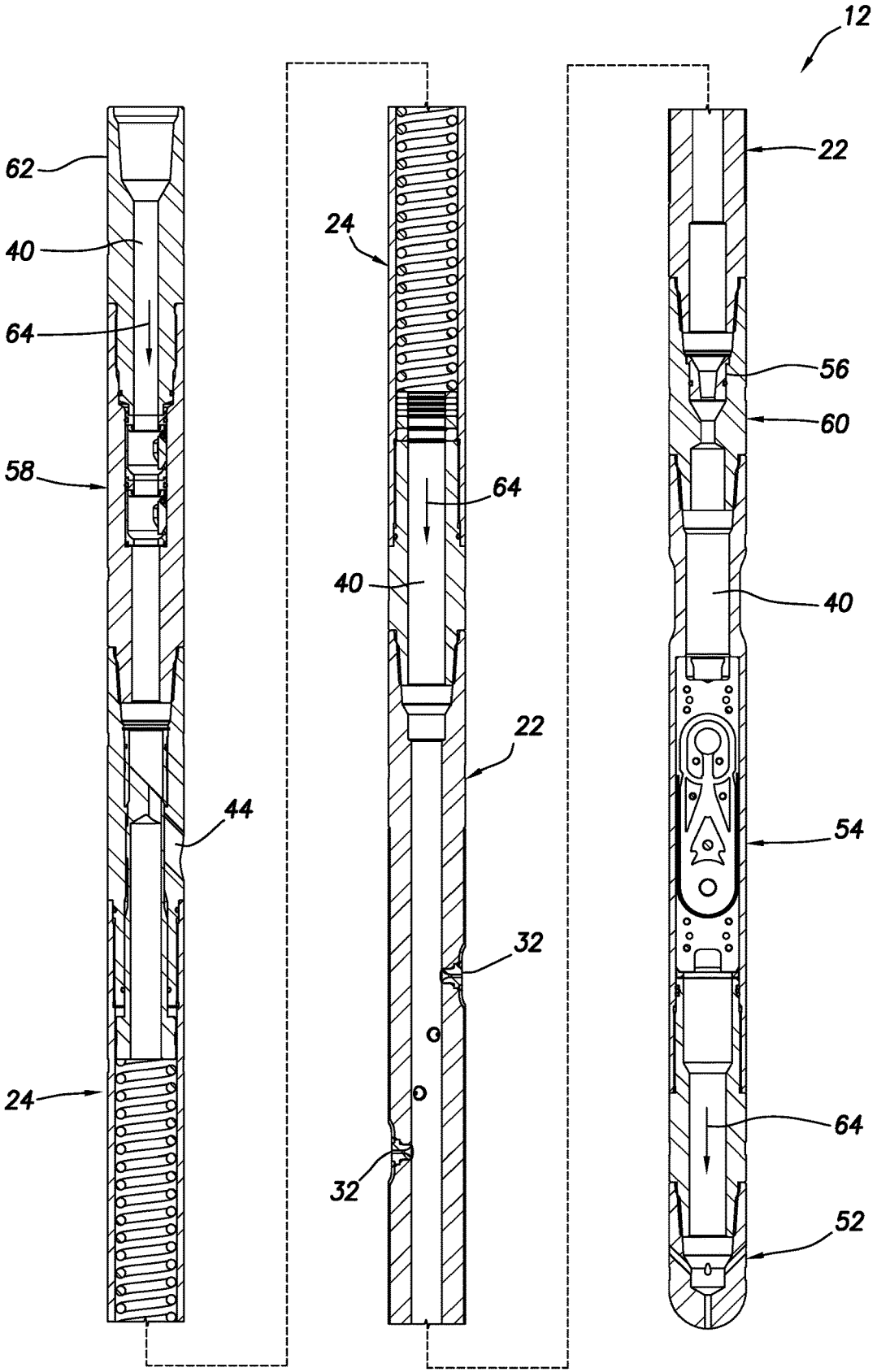
FIG. 5 is a representative cross-sectional view of an example of a bottom hole assembly that may be used in the system and method.

Referring additionally now to FIG. 5, a cross-sectional view of another example of the bottom hole assembly 12 is representatively illustrated. The FIG. 5 bottom hole assembly 12 may be used in the FIGS. 1-4 system 10 and method, or it may be used in other systems and methods. For convenience, the bottom hole assembly 12 is described below as it may be used in the FIGS. 1-4 system 10 and method.

In the FIG. 5 example, the bottom hole assembly 12 includes the abrasive perforator 22 and the plug dispenser tool 24. In addition, the FIG. 5 bottom hole assembly 12 includes a wash tool 52, a vibratory tool 54, a plug seat assembly 60 and a back pressure valve 58. Other elements and other combinations of elements may be used in other examples.

The bottom hole assembly 12 is depicted in FIG. 5 in a run-in configuration. An upper internally threaded connector 62 facilitates connecting the bottom hole assembly 12 at the distal end of the tubular string 14, so that the internal flow passage 40 extends through the bottom hole assembly. Fluid 64 can be circulated completely through the tubular string 14 and the bottom hole assembly 12 as they are being deployed into the wellbore 16.

The wash tool 52 can be used to clean an interior surface of the casing 18 during or after deployment of the bottom hole assembly 12. The vibratory tool 54 produces vibrations in response to the flow of the fluid 64 through the vibratory tool. The vibrations can reduce friction between the tubular string 14 and the interior surface of the casing 18, for example, to assist in deploying the bottom hole assembly 12 into an extended length lateral wellbore.

The plug seat assembly 60 includes a plug seat 56. A plug can be deployed from the surface into the flow passage 40, and eventually the plug will engage the plug seat 56 to block flow through the flow passage. Blocking flow through the plug seat 56 enables increased pressure to be built up in the flow passage 40 uphole of the plug seat, for example, to obtain increased flow through the nozzles 32 when perforations 26, 48 are formed using the abrasive perforator 22.

The back pressure valve 58 is included in the bottom hole assembly 12 to prevent inadvertent fluid flow uphole through the tubular string 14. The back pressure valve 58 functions as a check valve that permits fluid flow in a downhole direction (as depicted in FIG. 5), but prevents fluid flow in an uphole direction through the back pressure valve.

In an example of a method utilizing the FIG. 5 bottom hole assembly 12 in the FIGS. 1-4 system 10, the bottom hole assembly would be deployed into the wellbore 16 in the run-in configuration depicted in FIG. 5. The bottom hole assembly 12 would be connected at a distal end of the tubular string 14.

The fluid 64 can be circulated through the flow passage 40 as the tubular string 14 is deployed into the wellbore 16. The fluid 64 can exit the wash tool 52 at a distal end of the bottom hole assembly 12, thereby cleaning the interior surface of the casing 18. The flow of the fluid 64 through the vibratory tool 54 produces vibrations in the tubular string 14.

The bottom hole assembly 12 is displaced to a position at which it is desired to form the perforations 26, that is, the nozzles 32 of the abrasive perforator 22 are positioned opposite the location along the wellbore 16 where it is desired to form the perforations 26. A plug (not shown) is deployed into the flow passage 40. The plug eventually engages the plug seat 56, thereby blocking flow to the flow passage 40 downhole of the plug seat.

The abrasive slurry 30 is pumped through the flow passage 40 to the abrasive perforator 22. The abrasive slurry 30 exits the nozzles 32 as jets 34, which cut through the casing 18 and cement 20, and into the zone 28, to thereby form the perforations 26.

The stimulation fluid 36 is pumped through the annulus 38 and/or the flow passage 40 to the perforations 26. The stimulation fluid 36 flows through the perforations 26 and into the zone 28, thereby stimulating the zone.

The bottom hole assembly 12 is displaced uphole to a position in which the abrasive perforator 22 is no longer opposite the perforations 26, and the wellbore 16 at the perforations is not obstructed. This displacement of the bottom hole assembly 12 may occur while the stimulation fluid 36 is being pumped.

After the stimulation operation, one or more plugs 42 are deployed into the flow passage 40. Flow of a fluid 46 through the flow passage 40 carries each of the plugs 42 to the plug dispenser tool 24. The fluid 46 may be the same as the stimulation fluid 36, or it may be a different fluid.

As described more fully below, the plug 42 engages a seat in the plug dispenser tool 24, thereby enabling a pressure differential to be created across the plug and a piston of the plug dispenser tool. When a sufficient pressure differential is achieved, the plug 42 is discharged from the plug discharge port 44.

The same number of plugs 42 may be discharged from the plug dispenser tool 24 as the number of perforations 26. In some examples, however, the number of plugs 42 discharged may be greater or fewer than the number of perforations 26.

After a plug 42 has been discharged from the plug dispenser tool 24, the flow of the fluid 46 carries the plug to an unblocked one of the perforations 26. The plug 42 engages the perforation 26 to thereby block flow from the wellbore 16 to the zone 28 via the perforation.

When all of the perforations 26 have been plugged with the plugs 42, the bottom hole assembly 12 is displaced to another position at which it is desired to form the perforations 48 into the zone 50. In some examples, this displacement of the bottom hole assembly 12 may be performed while the plugs 42 are still being discharged from the plug dispenser tool 24 to plug the perforations 26.

The abrasive slurry 30 is again pumped through the flow passage 40 to the abrasive perforator 22 to form the perforations 48, as described above for forming the perforations 26. The additional steps of stimulating the zone 50, displacing the bottom hole assembly 12, and plugging the perforations 48 are performed for the zone 50 as described above for the zone 28. Any number of zones can be perforated and stimulated by repeating the above sequence of steps for each zone, except that it typically would not be necessary for the last zone to be plugged.

Figure 6:
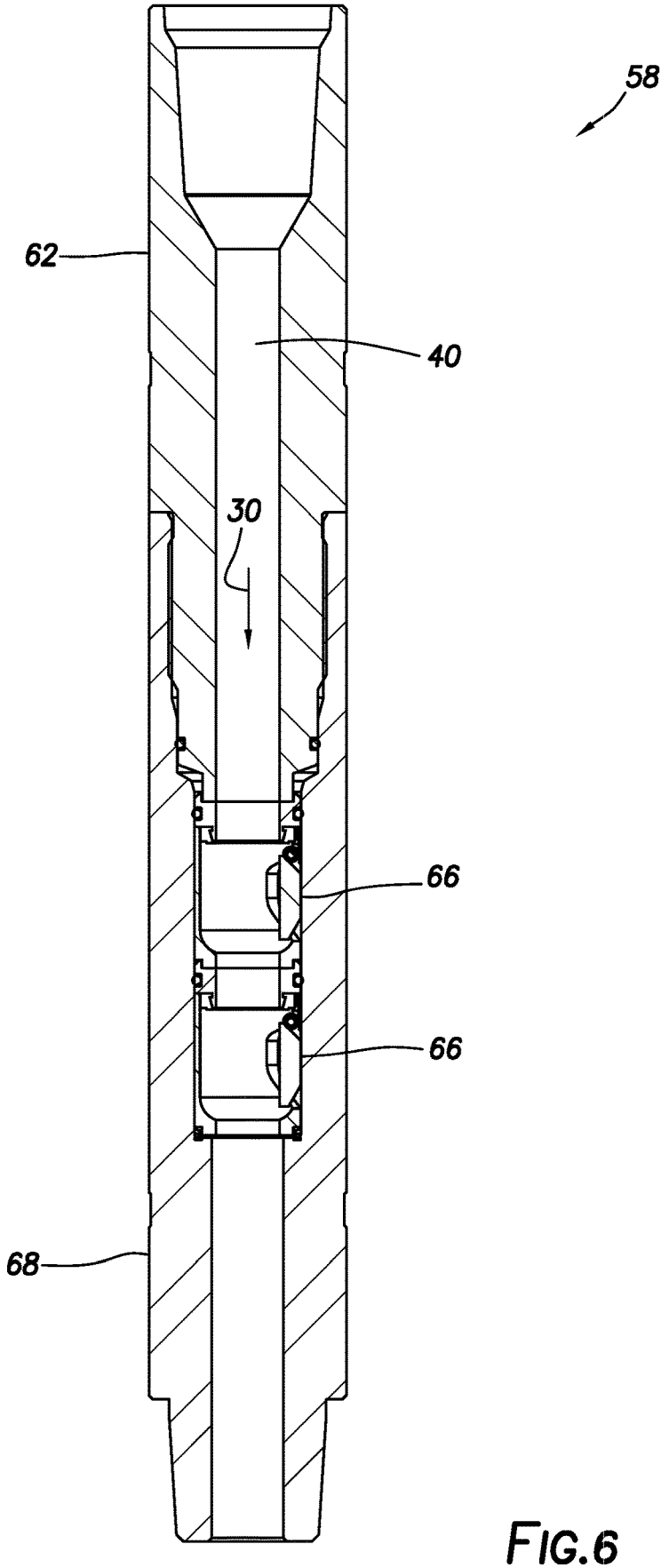
FIG. 6 is a representative cross-sectional view of an example of a back pressure valve that may be used in the bottom hole assembly.

Referring additionally now to FIG. 6, a cross-sectional view of an example of the back pressure valve 58 is representatively illustrated. In this example, the back pressure valve 58 includes the upper connector 62 and a pair of flapper valves 66 operatively disposed in a housing 68.

The flow passage 40 extends longitudinally through the upper connector 62 and the housing 68. If a fluid in the flow passage 40 begins to flow uphole (upward as viewed in FIG. 6), the flapper valves 66 will close, thereby preventing such flow in the uphole direction.

Figure 7:
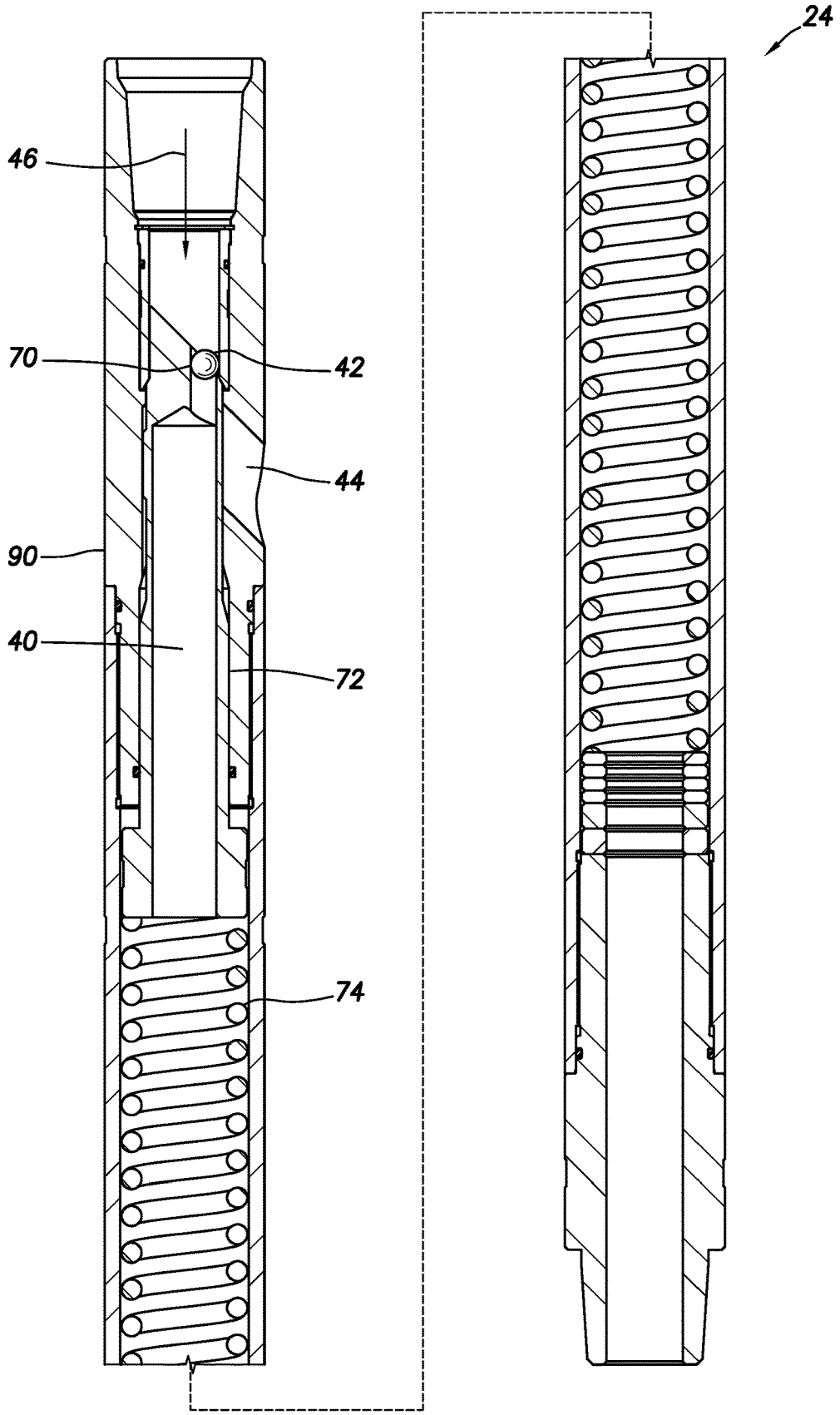
FIG. 7 is a representative cross-sectional view of an example of a plug dispenser tool that may be used in the bottom hole assembly.

Referring additionally now to FIG. 7, a cross-sectional view of an example of the plug dispenser tool 24 is representatively illustrated. A suitable tool for use as the plug dispenser tool 24 is described in U.S. application Ser. No. 18/295,411 filed on Apr. 4, 2023, the entire disclosure of which is incorporated herein by this reference for all purposes.

As depicted in FIG. 7, a plug 42 has been deployed into the flow passage 40. The plug 42 is sealingly engaged with a seat 70 formed in an upper end of an annular piston 72. When the plug 42 is engaged with the seat 70, a pressure differential can be created in the flow passage 40 across the plug 42 and the piston 72.

When the plug 42 is engaged with the seat 70 and a sufficient pressure differential is created across the plug 42 and the piston 72, the plug and piston will be displaced downhole (downward as viewed in FIG. 7) against a biasing force exerted by a biasing device 74. The biasing device 74 is depicted in FIG. 7 as being a coiled compression spring, but other types of biasing devices (such as, a resilient material, a compressed gas, etc.) may be used in other examples.

The upper end of the piston 72 initially blocks the plug discharge port 44, which is formed through a side wall of a generally tubular outer housing 90. However, when the plug 42 and the piston 72 are displaced downward by the pressure differential, eventually the plug discharge port 44 will be unblocked, and the plug 42 can be discharged outward through the plug discharge port.

After the plug 42 is discharged, the pressure differential will no longer exist across the piston 72. The biasing device 74 will, therefore, displace the piston 72 back to the initial position depicted in FIG. 7, ready for the deployment and discharge of another plug 42.

Figure 8:
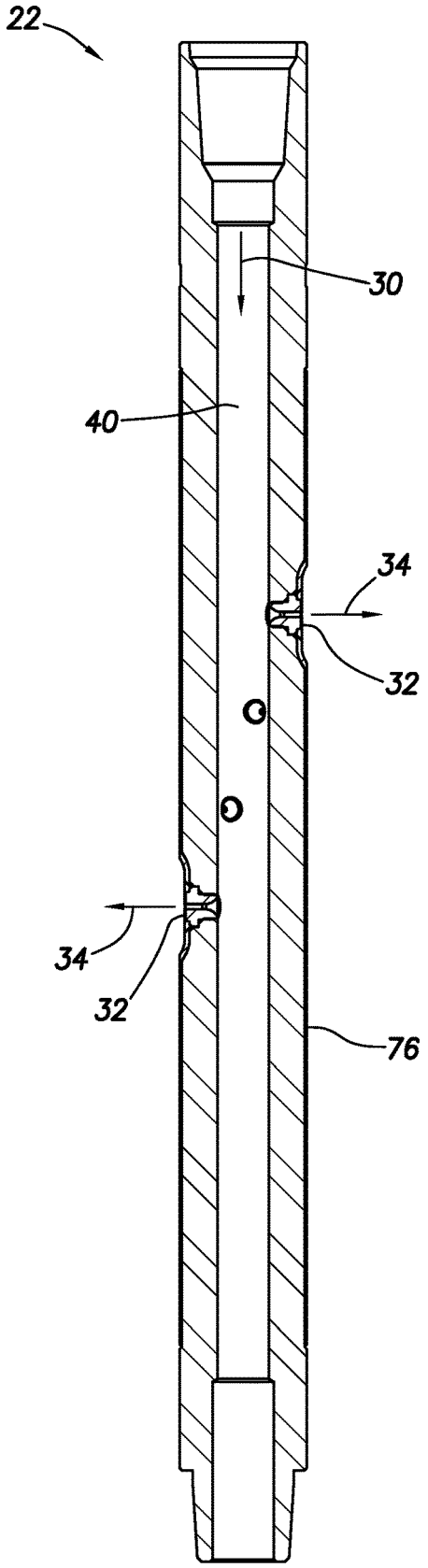
FIG. 8 is a representative cross-sectional view of an example of an abrasive perforator that may be used in the bottom hole assembly.

Referring additionally now to FIG. 8, a cross-sectional view of an example of the abrasive perforator 22 is representatively illustrated. In this view it may be seen that the abrasive perforator 22 includes a generally tubular housing 76 in which the nozzles 32 are installed.

Any number of nozzles 32 may be included in the abrasive perforator 22. When it is desired to form perforations 26, 48, the abrasive slurry 30 is pumped to the abrasive perforator 22, and the abrasive slurry forms the jets 34 as it exits the nozzles 32.

Figure 9:
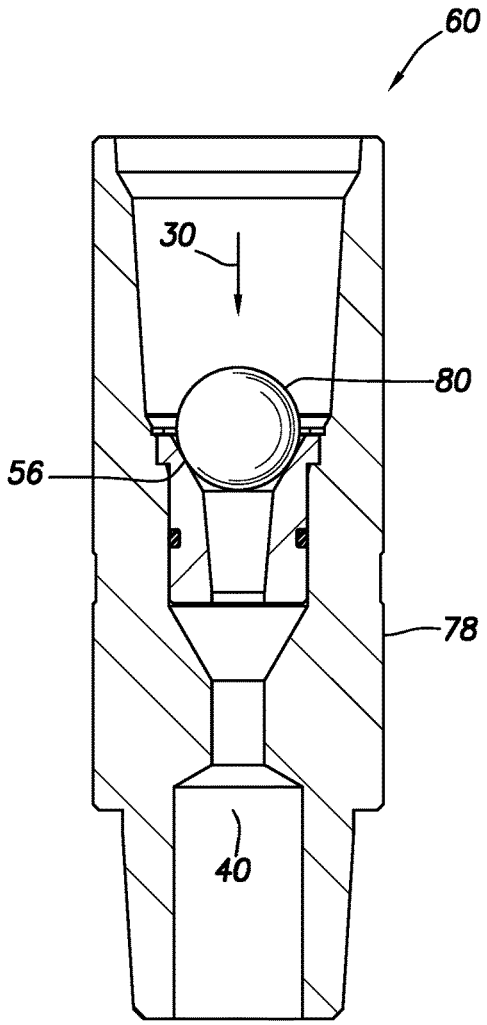
FIG. 9 is a representative cross-sectional view of an example of a plug seat assembly that may be used in the bottom hole assembly.

Referring additionally now to FIG. 9, a cross-sectional view of an example of the plug seat assembly 60 is representatively illustrated. In this example, the assembly 60 includes the plug seat 56 installed in a generally tubular housing 78.

When it is desired to use the abrasive perforator 22 to form perforations, a suitably dimensioned plug 80 can be deployed into the flow passage 40. The plug 80 will eventually engage and block flow through the plug seat 56 to prevent flow through the flow passage 40 downhole of the plug seat. The plug 80 is preferably dimensioned so that it will pass through the seat 70 in the plug dispenser tool 24.

Figure 10:
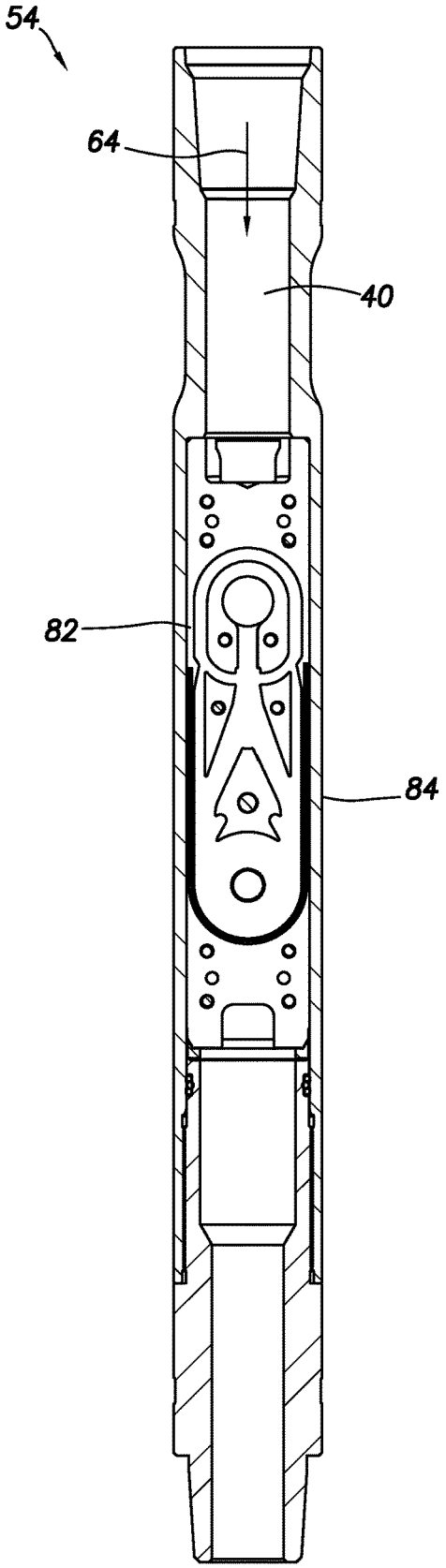
FIG. 10 is a representative cross-sectional view of an example of a vibratory tool that may be used in the bottom hole assembly.

Referring additionally now to FIG. 10, a cross-sectional view of an example of the vibratory tool 54 is representatively illustrated. The vibratory tool 54 may comprise any of the vibratory tools described in U.S. Pat. Nos. 9,181,767, 9,637,976, 9,957,765 and 11525307, the entire disclosures of which are incorporated herein by this reference for all purposes.

In the FIG. 10 example, the vibratory tool 54 includes a fluidic insert 82 disposed in a generally tubular housing 84. The flow passage 40 extends through the fluidic insert 82 and the housing 84.

Due to the construction of the fluidic insert 82, a restriction to flow through the fluidic insert fluctuates. As a result, a momentum of the fluid flow through the flow passage 40 also fluctuates, and vibrations are produced in the tubular string 14.

Figure 11:
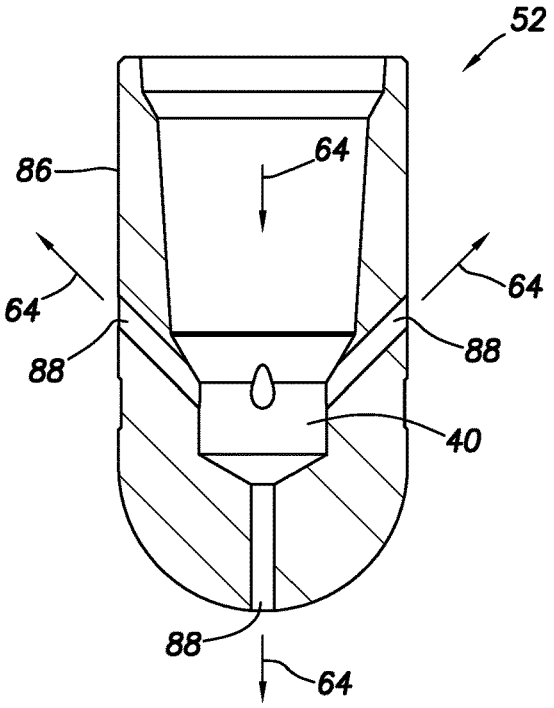
FIG. 11 is a representative cross-sectional view of an example of a wash tool that may be used in the bottom hole assembly.

Referring additionally now to FIG. 11, a cross-sectional view of an example of the wash tool 52 is representatively illustrated. In this example, the wash tool 52 includes a housing 86 having a threaded upper end and a lower end that is closed off, except for nozzles 88 formed through the lower end of the housing.

A fluid 64 circulated through the flow passage 40 to the wash tool 52 will exit the nozzles 88 at an increased velocity. The increased velocity enhances a cleaning effectiveness of the fluid flow.

It may now be fully appreciated that the above disclosure provides significant advancements to the art of completing wells. In examples described above, multiple formation zones 28, 50 can be perforated, stimulated and plugged in a single trip of the bottom hole assembly 12 into the wellbore 16.

The above disclosure provides to the art a bottom hole assembly 12 for use in a subterranean well. In one example, the bottom hole assembly 12 can comprise an abrasive perforator 22 with at least one nozzle 32 configured to direct an abrasive jet 34 outward from the abrasive perforator 22, and a plug dispenser tool 24 configured to discharge at least one first plug 42 via a plug discharge port 44 into an annulus 38 surrounding the plug dispenser tool 24.

The plug dispenser tool 24 may be further configured to discharge the first plug 42 in response to a predetermined pressure differential applied across the first plug 42.

The abrasive perforator 22 may be connected in the bottom hole assembly 12 between the plug dispenser tool 24 and a plug seat 56. The plug seat 56 may be configured to selectively prevent flow through a central flow passage 40 extending through the bottom hole assembly 12 when a second plug 80 is engaged with the plug seat 56.

The plug seat 56 may be connected in the bottom hole assembly 12 between the abrasive perforator 22 and a vibratory tool 54. The vibratory tool 54 may be configured to produce vibrations in response to fluid flow through the flow passage 40.

The plug dispenser tool 24 may include an outer housing 90 having the plug discharge port 44 that provides fluid communication between an exterior of the outer housing 90 and a flow passage 40 extending longitudinally through the plug dispenser tool 24, a piston 72 slidably disposed in the outer housing 90 between a closed position in which the piston 72 blocks fluid flow through the plug discharge port 44, and an open position in which fluid flow through the plug discharge port 44 is permitted, and a biasing device 74 that biases the piston 72 toward the closed position.

The above disclosure also provides to the art a method of completing a well. In one example, the method can include the steps of: deploying a bottom hole assembly 12 into a wellbore 16; perforating at least one first zone 28 with an abrasive perforator 22 of the bottom hole assembly 12; and then discharging at least one first plug 42 from a plug discharge port 44 of a plug dispenser tool 24 of the bottom hole assembly 12. The discharging step includes the at least one first plug 42 displacing from an internal flow passage 40 of the bottom hole assembly 12 to an annulus 38 formed between the bottom hole assembly 12 and the wellbore 16.

The discharging step may further include engaging the first plug 42 with a seat 70 of the plug discharge tool 24, thereby enabling a pressure differential to be created across a piston 72 and the first plug 42.

The piston 72 may block flow through the plug discharge port 44, and then the piston 72 may displace to a position in which the piston 72 does not block flow through the plug discharge port 44, in response to the pressure differential being created across the piston 72.

The method may include perforating at least one second zone 50 with the abrasive perforator 22. The step of perforating the at least one first zone 28, the discharging step and the step of perforating the at least one second zone 50 may be performed in a single trip of the bottom hole assembly 12 into the wellbore 16.

The method may include, after the step of perforating the at least one second zone 50, then discharging at least one second plug 42 from the plug discharge port 44 of the plug dispenser tool 24.

The method may include stimulating the at least one first zone 28 after the perforating step and prior to the discharging step.

The stimulating step may include pumping stimulation fluid 36 through the annulus 38 to perforations 26 extending into the at least one first zone 28. The stimulating step may include pumping stimulation fluid 36 through the internal flow passage 40 to perforations 26 extending into the at least one first zone 28.

Another method of completing a well can include the steps of: deploying a bottom hole assembly 12 into a wellbore 16; forming first perforations 26 in a first zone 28 with an abrasive perforator 22 of the bottom hole assembly 12; then displacing the bottom hole assembly 12 to a first position in which the bottom hole assembly 12 is not adjacent the first perforations 26; and then discharging at least one first plug 42 from a plug discharge port 44 of a plug dispenser tool 24 of the bottom hole assembly 12.

The method may include stimulating the first zone 28 after the forming step and prior to the displacing step.

The method may include blocking flow through the first perforations 26 with the at least one first plug 42; then displacing the bottom hole assembly 12 to a second position; and then forming second perforations 48 at the second position in a second zone 50 with the abrasive perforator 22.

The discharging step may include the at least one first plug 42 displacing from an internal flow passage 40 of the bottom hole assembly 12 to an annulus 38 formed between the bottom hole assembly 12 and the wellbore 16. The discharging step may further include engaging the first plug 42 with a seat 70 of the plug discharge tool 24, thereby enabling a pressure differential to be created across a piston 72 and the first plug 42.

The piston 72 may initially block flow through the plug discharge port 44, and then displace to a position in which the piston 72 does not block flow through the plug discharge port 44, in response to the pressure differential being created across the piston 72.

The method may include perforating a second zone 50 with the abrasive perforator 22. The step of forming the first perforations 26, the discharging step and the step of perforating the second zone 50 may be performed in a single trip of the bottom hole assembly 12 into the wellbore 16. The method may include, after the step of perforating the second zone 50, then discharging at least one second plug 42 from the plug discharge port 44 of the plug dispenser tool 24.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A bottom hole assembly for use in a subterranean well, the bottom hole assembly comprising:

an abrasive perforator comprising at least one nozzle configured to direct an abrasive jet outward from the abrasive perforator; and a plug dispenser tool configured to discharge at least one first plug via a plug discharge port into an annulus surrounding the plug dispenser tool, in which the plug dispenser tool comprises a piston displaceable between a first position in which the piston blocks the plug discharge port, and a second position in which the plug discharge port is open, and a biasing device that applies a biasing force to the piston, in which a longitudinal flow passage of the plug dispenser tool extends through the piston, and in which the first plug is configured to block the longitudinal flow passage and displace the piston from the first position to the second position in response to a predetermined pressure differential applied across the first plug.

2. The bottom hole assembly of claim 1, in which the plug dispenser tool is further configured to discharge the first plug in response to the predetermined pressure differential applied across the first plug when the piston has been displaced by the first plug to the second position.

3. The bottom hole assembly of claim 1, in which the abrasive perforator is connected in the bottom hole assembly between the plug dispenser tool and a plug seat.

4. The bottom hole assembly of claim 3, in which the plug seat is configured to selectively prevent flow through a central flow passage extending through the bottom hole assembly when a second plug is engaged with the plug seat.

5. The bottom hole assembly of claim 3, in which the plug seat is connected in the bottom hole assembly between the abrasive perforator and a vibratory tool.

6. The bottom hole assembly of claim 5, in which the vibratory tool is configured to produce vibrations in response to fluid flow through the flow passage.

7. The bottom hole assembly of claim 1, in which the plug dispenser tool further comprises:

an outer housing having the plug discharge port that provides fluid communication between an exterior of the outer housing and the flow passage extending longitudinally through the plug dispenser tool, in which the piston is slidably disposed in the outer housing between the first and second positions; and in which the biasing device that biases the piston toward the first position.

8. A method of completing a well, the method comprising:

deploying a bottom hole assembly into a wellbore;

perforating at least one first zone with an abrasive perforator of the bottom hole assembly; and then discharging at least one first plug from a plug discharge port of a plug dispenser tool of the bottom hole assembly, the discharging comprising the at least one first plug displacing from an internal flow passage of the bottom hole assembly to an annulus formed between the bottom hole assembly and the wellbore, in which, prior to the discharging, the first plug blocks a longitudinal flow passage extending through a piston of the plug dispenser tool and displaces the piston in response to a predetermined pressure differential applied across the first plug and a biasing device applies a biasing force to the piston.

9. The method of claim 8, in which the discharging further comprises engaging the first plug with a seat of the plug discharge tool, thereby enabling the pressure differential to be created across the piston and the first plug.

10. The method of claim 9, in which the piston blocks flow through the plug discharge port, and then the piston displaces to a position in which the piston does not block flow through the plug discharge port, in response to the pressure differential being created across the piston.

11. The method of claim 8, further comprising perforating at least one second zone with the abrasive perforator, and in which the perforating the at least one first zone, the discharging and the perforating the at least one second zone are performed in a single trip of the bottom hole assembly into the wellbore.

12. The method of claim 11, further comprising, after the perforating the at least one second zone, then discharging at least one second plug from the plug discharge port of the plug dispenser tool.

13. The method of claim 8, further comprising stimulating the at least one first zone after the perforating and prior to the discharging.

14. The method of claim 13, in which the stimulating comprises pumping stimulation fluid through the annulus to perforations extending into the at least one first zone.

15. The method of claim 13, in which the stimulating comprises pumping stimulation fluid through the internal flow passage to perforations extending into the at least one first zone.

16. A method of completing a well, the method comprising:

deploying a bottom hole assembly into a wellbore;

forming first perforations in a first zone with an abrasive perforator of the bottom hole assembly;

then displacing the bottom hole assembly to a first position in which the bottom hole assembly is not adjacent the first perforations; and then discharging at least one first plug from a plug discharge port of a plug dispenser tool of the bottom hole assembly, in which, prior to the discharging, the first plug blocks a longitudinal flow passage extending through a piston of the plug dispenser tool and displaces the piston in response to a predetermined pressure differential applied across the first plug and a biasing device applies a biasing force to the piston.

17. The method of claim 16, further comprising stimulating the first zone after the forming and prior to the displacing.

18. The method of claim 17, further comprising:

blocking flow through the first perforations with the at least one first plug;

then displacing the bottom hole assembly to a second position; and then forming second perforations at the second position in a second zone with the abrasive perforator.

19. The method of claim 16, in which the discharging comprises the at least one first plug displacing from an internal flow passage of the bottom hole assembly to an annulus formed between the bottom hole assembly and the wellbore.

20. The method of claim 19, in which the discharging further comprises engaging the first plug with a seat of the plug discharge tool, thereby enabling the pressure differential to be created across the piston and the first plug.

21. The method of claim 20, in which the piston blocks flow through the plug discharge port, and then the piston displaces to a position in which the piston does not block flow through the plug discharge port, in response to the pressure differential being created across the piston.

22. The method of claim 16, further comprising perforating a second zone with the abrasive perforator, and in which the forming the first perforations, the discharging and the perforating the second zone are performed in a single trip of the bottom hole assembly into the wellbore.

23. The method of claim 22, further comprising, after the perforating the second zone, then discharging at least one second plug from the plug discharge port of the plug dispenser tool.

* * * * *